US009807528B1

(12) United States Patent
Jensen et al.

(10) Patent No.: US 9,807,528 B1
(45) Date of Patent: Oct. 31, 2017

(54) ELECTRONIC DEVICES AND METHOD FOR THERMAL MONITORING OF AN ELECTRO-MECHANICAL ACTUATOR

(71) Applicant: Apple Inc., Cupertino, CA (US)

(72) Inventors: Thomas M. Jensen, San Francisco, CA (US); David T. Yeh, San Jose, CA (US)

(73) Assignee: APPLE INC., Cupertino, CA (US)

( * ) Notice: Subject to any disclaimer, the term of this patent is extended or adjusted under 35 U.S.C. 154(b) by 12 days.

(21) Appl. No.: 14/860,417

(22) Filed: Sep. 21, 2015

(51) Int. Cl.

| | |
|---|---|
| ***H04R 29/00*** | (2006.01) |
| ***H04R 9/06*** | (2006.01) |
| ***H04R 9/02*** | (2006.01) |
| ***H04R 3/00*** | (2006.01) |

(52) U.S. Cl.
CPC ..... *H04R 29/003* (2013.01); *H04R 3/007* (2013.01); *H04R 9/022* (2013.01); *H04R 9/06* (2013.01)

(58) Field of Classification Search
CPC .... H04R 29/003; H04R 3/007; H04R 29/001; H04R 3/08; H04R 1/00; H04R 2209/041; H04R 2499/11; H04R 3/002; H04R 7/12; H04R 9/00; H04R 9/022; H04R 9/02; H04R 9/046; H04R 2430/01; H04R 29/00; H04R 3/02; H04R 9/06; H04R 3/00; H04R 3/04
USPC ..... 381/59, 55, 96, 400, 58, 118, 120, 121, 381/386, 401, 421, 61, 471, 400.22, 244, 381/400.01, 400.21, 473, 490, 567, 632, 381/700, 806
See application file for complete search history.

(56) References Cited

U.S. PATENT DOCUMENTS

| | | | | |
|---|---|---|---|---|
| 5,005,089 | A | 4/1991 | Thanos et al. | |
| 6,625,287 | B1 * | 9/2003 | Wurtz | H04R 3/002 327/110 |
| 7,447,318 | B2 * | 11/2008 | Button | H04R 3/00 381/116 |
| 7,731,418 | B2 | 6/2010 | Price | |
| 8,179,751 | B2 | 5/2012 | Hezemans | |
| 2007/0070560 | A1 * | 3/2007 | Hikawa | G01K 7/00 361/29 |
| 2013/0077795 | A1 | 3/2013 | Risbo et al. | |
| 2013/0259245 | A1 * | 10/2013 | Cheng | H04R 3/00 381/58 |

(Continued)

FOREIGN PATENT DOCUMENTS

WO 2013182901 A1 12/2013

*Primary Examiner* — Akelaw Teshale
(74) *Attorney, Agent, or Firm* — Blakely Sokoloff Taylor & Zafman LLP

(57) ABSTRACT

Method to perform thermal monitoring of an electro-mechanical actuator included in a device starts by receiving an in-field calibration temperature from a temperature sensor included in the device. The device may also receive an in-field calibration resistance from a resistance calculator included in the device. A calculated thermal coefficient of resistivity of the electro-mechanical actuator is then computed using an equation that relates the calculated thermal coefficient of resistivity to the in-field calibration temperature. The calculated thermal coefficient of resistivity changes based on the in-field calibration temperature. The equation includes parameters that are stored in the device. A temperature estimate of the electro-mechanical actuator is them computed based on the calculated thermal coefficient of resistivity. Other embodiments are also described.

25 Claims, 5 Drawing Sheets

(56) References Cited

U.S. PATENT DOCUMENTS

| | | | | |
|---|---|---|---|---|
| 2014/0086418 | A1 | 3/2014 | Lubberhuizen et al. | |
| 2014/0126730 | A1* | 5/2014 | Crawley | H04R 29/001 381/59 |
| 2015/0200068 | A1* | 7/2015 | Kinoshita | H01H 47/04 361/170 |
| 2015/0256931 | A1* | 9/2015 | Ishii | H04R 3/007 381/55 |

* cited by examiner

ELECTRONIC DEVICES AND METHOD FOR THERMAL MONITORING OF AN ELECTRO-MECHANICAL ACTUATOR

FIELD

An embodiment of the invention relate generally to an electronic device that monitors temperature of an electro-mechanical actuator. Specifically, it is recognized that the thermal coefficient of resistivity varies based on the temperature at the time of calibration. In the production environment, the parameters of the equation that relates the thermal coefficient of resistivity to the calibration temperature are determined and stored in the electronic device. A device may then use the parameters and the calibration temperature in the equation to calculate the thermal coefficient of resistivity, which may then be used to calculate the temperature of the electro-mechanical actuator (e.g., a voice coil of a speaker).

In one embodiment, the electronic device may perform in-field self-calibration, for instance, (i) when the electro-mechanical actuator is installed in the device, (ii) at bootup of the device, and/or (iii) after a software update of the device. When the electronic device performs self-calibration, the electronic device computes the calculated thermal coefficient of resistivity of the electro-mechanical actuator using the equation, the parameters stored in the device, and an in-field calibration temperature received from a temperature sensor included in the device.

BACKGROUND

Currently, a number of consumer electronic devices include internal speakers and are adapted to output audio signals including speech and music via speaker ports. An internal speaker comprises a speaker box and a speaker driver. The speaker box is an acoustic chamber that includes the speaker port and at least partially encloses a speaker driver. The speaker driver includes a diaphragm, a voice coil, a magnet unit and a yoke.

For audio to be played, current is applied to the speaker driver which also causes the voice coil to generate heat. The voice coil in the speaker driver is coupled to the magnet unit and thus, the heat from the voice coil is transferred to the magnet unit. The amount of power that may be applied to the speaker box is limited by the resilience of the magnet unit and the voice coil to heat. Exposing too much heat to the voice coil may cause (i) the voice coil wire to short or burn due to the bonding material melting around the wire, (ii) suspension surround softening or breaking, and (ii) diaphragm dome delaminating and softening. Overheating any magnet will cause structural or mechanical damage to the magnet and may result in its demagnetization. Accordingly, the temperature of the voice coil needs to be monitored to ensure that the integrity of the speaker is maintained.

SUMMARY

Generally, the invention relates to methods and electronic devices to perform thermal monitoring of electro-mechanical actuators. The electro-mechanical actuator may be, for instance, a speaker such that the electronic devices monitor the speaker voice coil temperature for temperature control. It is found that for situations where the temperature conditions of the production environment can't be controlled, the thermal coefficient of resistivity will not be a constant, but rather may vary based on the calibration temperature at the time of calibration. Accordingly, using a calculated thermal coefficient of resistivity that is based on the calibration temperature, a more precise thermal coefficient may be obtained and used to calculate the temperature estimate of the electro-mechanical actuator (e.g., a voice coil in a speaker) via a temperature coefficient equation of electro-mechanical actuator materials. Using this temperature estimate, the output levels of the electro-mechanical actuator may be maintained within safe limits.

In one embodiment, a method for thermal monitoring of an electro-mechanical actuator included in a device starts by receiving an in-field calibration temperature from a temperature sensor included in the device. The device may also receive an in-field calibration resistance from a resistance calculator included in the device. The device may then compute a calculated thermal coefficient of resistivity of the electro-mechanical actuator using an equation that relates the calculated thermal coefficient of resistivity to the new calibration temperature. The calculated thermal coefficient of resistivity changes based on the in-field calibration temperature. Parameters included in the equation are stored in the device. A temperature estimate of the electro-mechanical actuator may then be computed based on the calculated thermal coefficient of resistivity.

In another embodiment, an electronic device for thermal monitoring of an electro-mechanical actuator comprises an electro-mechanical actuator being driven by an output signal, a temperature sensor to output an in-field calibration temperature, and a temperature estimator. The temperature estimator may include a memory storing the in-field calibration temperature and parameters of an equation that relates a calculated thermal coefficient of resistivity of the electro-mechanical actuator to the in-field calibration temperature. The calculated thermal coefficient of resistivity changes based on the in-field calibration temperature. The temperature estimator may also include a temperature converter to receive the parameters and the in-field calibration temperature from the memory as well as a resistance estimate from the resistance calculator, to compute the calculated thermal coefficient of resistivity of the electro-mechanical actuator using the parameters, the in-field calibration temperature and the equation, and to compute a temperature estimate of the electro-mechanical actuator (e.g., the voice coil included in the speaker) based on the calculated thermal coefficient of resistivity.

In another embodiment, computer-readable storage medium having instructions stored thereon, when executed by a processor, causes the processor to perform a method of thermal monitoring of an electro-mechanical actuator included in a device.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an"

or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
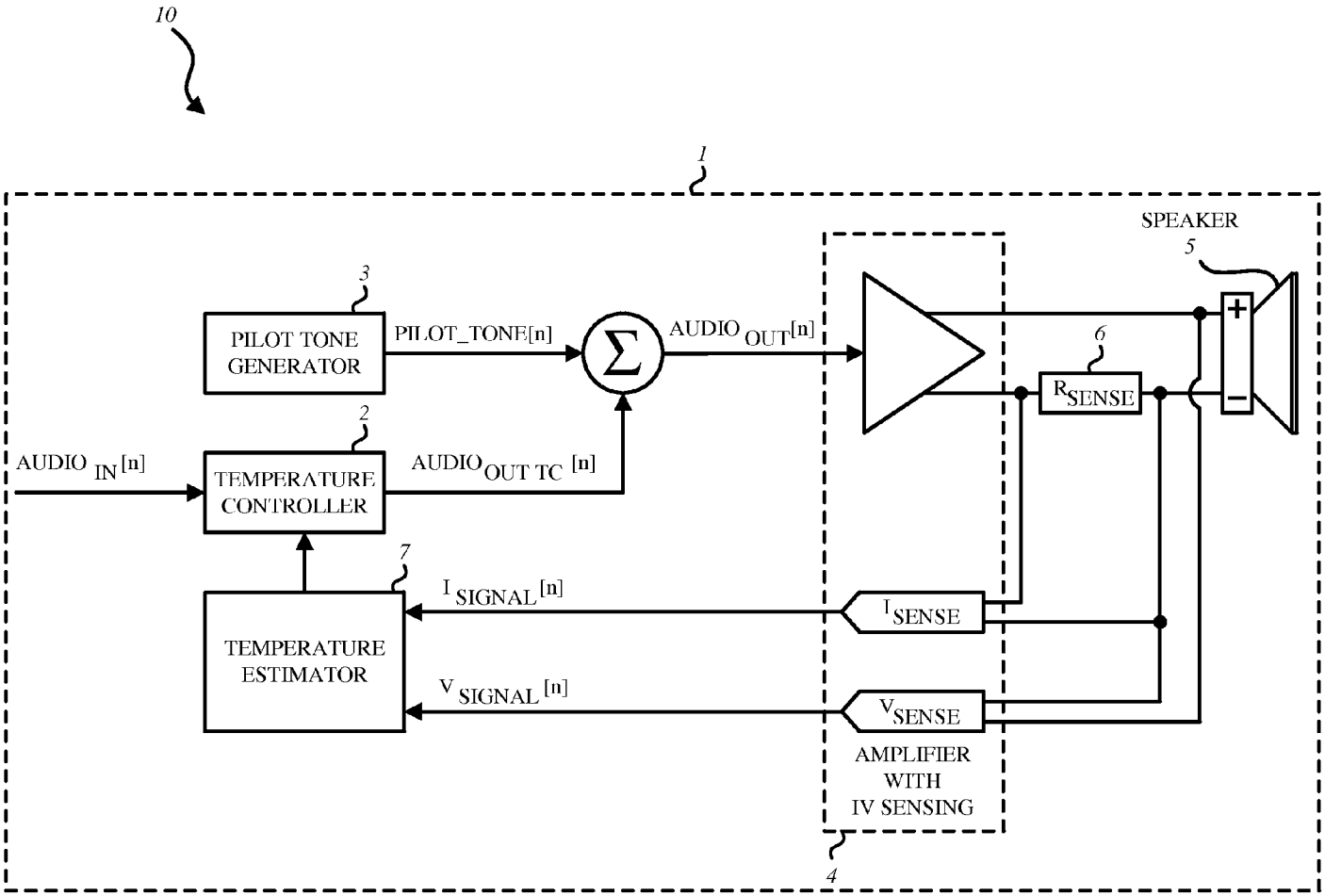
FIG. 1 illustrates a block diagram of an electronic device in which a system for thermal monitoring of an electro-mechanical actuator according to one embodiment of the invention may be implemented.

FIG. 1 illustrates a block diagram of an electronic device in which a system for thermal monitoring of an electro-mechanical actuator according to one embodiment of the invention may be implemented.

The electronic device 10 may be constrained in size and thickness and typically specifies speaker drivers in which an embodiment of the invention may be implemented. The electronic device 10 may be a mobile device such as a mobile telephone communications device or a smartphone. The electronic device 10 may also be a tablet computer, a personal digital media player or a notebook computer. The housing (also referred to as the external housing) encloses a plurality of electronic components of the electronic device 10. For example, the electronic device 10 may include electronic components such as a processor, a data storage containing an operating system and application software for execution by the processor, a display panel, and an audio codec providing audio signals to a speaker driver. The device housing has a speaker port (e.g., an acoustic port not shown). It is understood that embodiments of the invention may also be implemented in a non-mobile device such as a compact desktop computer.

In one embodiment, the electro-mechanical actuator that is being thermally monitored is a speaker. In this embodiment, as shown in FIG. 1, the system 1 for thermal monitoring speaker temperature includes a temperature controller 2, a pilot tone generator 3, an amplifier with current (I) and voltage (V) sensing 4, a speaker 5, a resistance element 6, and a temperature estimator 7.

The system 1 monitors the temperature of the voice coil included in the speaker 5 while the speaker 5 (e.g., a dynamic loudspeaker) is being driven by an audio signal that is also referred to as the primary audio. In some embodiments, the speaker 5 may be a microspeaker used for mobile devices 10. The audio signal may include voice, speech, sound effects, audio-visual (AV) audio, music, etc. For instance, the electronic device 10 may be adapted to receive transmissions from any content provider. An example of a "content provider" may include a company providing content for download over the Internet or other Internet Protocol (IP) based networks like an Internet service provider. In addition, the transmissions from the content providers may be a stream of digital content that is configured for transmission to one or more digital devices for viewing and/or listening. According to one embodiment, the transmission may contain MPEG (Moving Pictures Expert Group) compliant compressed video. The electronic device may also be coupled to a digital media player (e.g., DVD player) to receive and display the digital content for viewing and/or listening. Accordingly, when the user is using the electronic device 10 to listen to audio content or to view audio-visual content, the audio signal includes the audio content or the audio portion of the audio-visual content and the sound corresponding to the audio signal may be output by the speaker 5 from the speaker ports of the device 10.

In another embodiment, the electronic device 10 includes wireless communications devices having communications circuitry such as radio frequency (RF) transceiver circuitry, antennas, etc. . . . . In this embodiment, the microphone port, the speaker ports may be coupled to the communications circuitry to enable the user to participate in wireless telephone or video calls. A variety of different wireless communications networks and protocols may be supported in the wireless communications devices. These include: a cellular mobile phone network (e.g. a Global System for Mobile communications, GSM, network), including current 2G, 3G and 4G networks and their associated call and data protocols; and an IEEE 802.11 data network (WiFi or Wireless Local Area Network, WLAN) which may also support wireless voice over internet protocol (VOIP) calling. In one embodiment, the audio signal received by the system 1 includes voice signals that capture the user's speech (e.g., near-end speaker) or voice signals from the far-end speaker.

Referring back to FIG. 1, the audio input signal (e.g., $audio_{in}$ [n]) is received by the temperature controller 2 which may adjust the level of the audio signal based on a temperature estimate received from the temperature estimator 7 to output a temperature controlled audio output signal (e.g., $audio_{out\ TC}$ [n]). In order to obtain the temperature estimate, the pilot noise generator 3 generates a pilot tone (e.g., pilot_tone[n]) that is injected in the audio signal (e.g., $audio_{out\ TC}$ [n]). In other words, the pilot tone is mixed with the primary audio. As shown in FIG. 1, a combiner injects the pilot tone (e.g., pilot_tone [n]) that is output from the pilot tone generator 3 into the temperature controlled audio output signal from the temperature controller 2. As further shown in FIG. 1, the audio signal that includes the pilot tone (e.g., $audio_{out}$ [n]) is amplified by the amplifier 4 and is outputted by the speaker 5. The pilot tone provides excitation to the speaker 5 which generates a measurable voltage signal and current signal of the speaker 5. In one embodiment, the voice coil in the speaker 5 is monitored with analog-to-digital converters for voltage across the terminals of speaker 5 and for current through the terminal of speaker 5. As shown in FIG. 1, the current and voltage sensing in the amplifier 4 may receive signals from the speaker 5 to generate the current signal (e.g., $I_{signal}$ [n]) and the voltage signal (e.g., $V_{signal}$ [n]). Using these signals from the speaker 5, the low band impedance of the voice coil (e.g., voice coil resistance estimate) may be identified and converted to obtain an estimate of the temperature of the voice coil. As further shown in FIG. 1, a resistance element 6 (e.g., resistor) may be coupled to the speaker 5 and the current and voltage sensing included in the amplifier 4. As shown in FIG. 1, the temperature estimator 7 computes the voice coil resistance estimate that estimates a resistance of the voice coil and the temperature estimate based on the voice coil resistance estimate. This voice coil resistance estimate changes while the speaker 5 is being driven by the audio signal that includes the pilot tone. In other embodiments, in lieu of the pilot tone, the speaker 5 or other electro-mechanical actuators may be driven by a low level drive signal that includes a low level, low frequency noise.

In FIG. 1, the temperature estimator 7 outputs the temperature estimate to the temperature controller 2 which monitors the temperature estimate and adjusts the level of the audio signal based on the temperature estimate to ensure that the output level of the speaker 5 are within safe limits. For instance, the temperature controller 2 may decrease the level of the audio signal ($audio_{in}[n]$) to output the $audio_{out\ TC}[n]$ when the temperature controller 2 determines that the temperature estimate of the voice coil is above a temperature threshold that is indicates that the temperature of the voice coil is above an acceptable limit.

Figure 5:
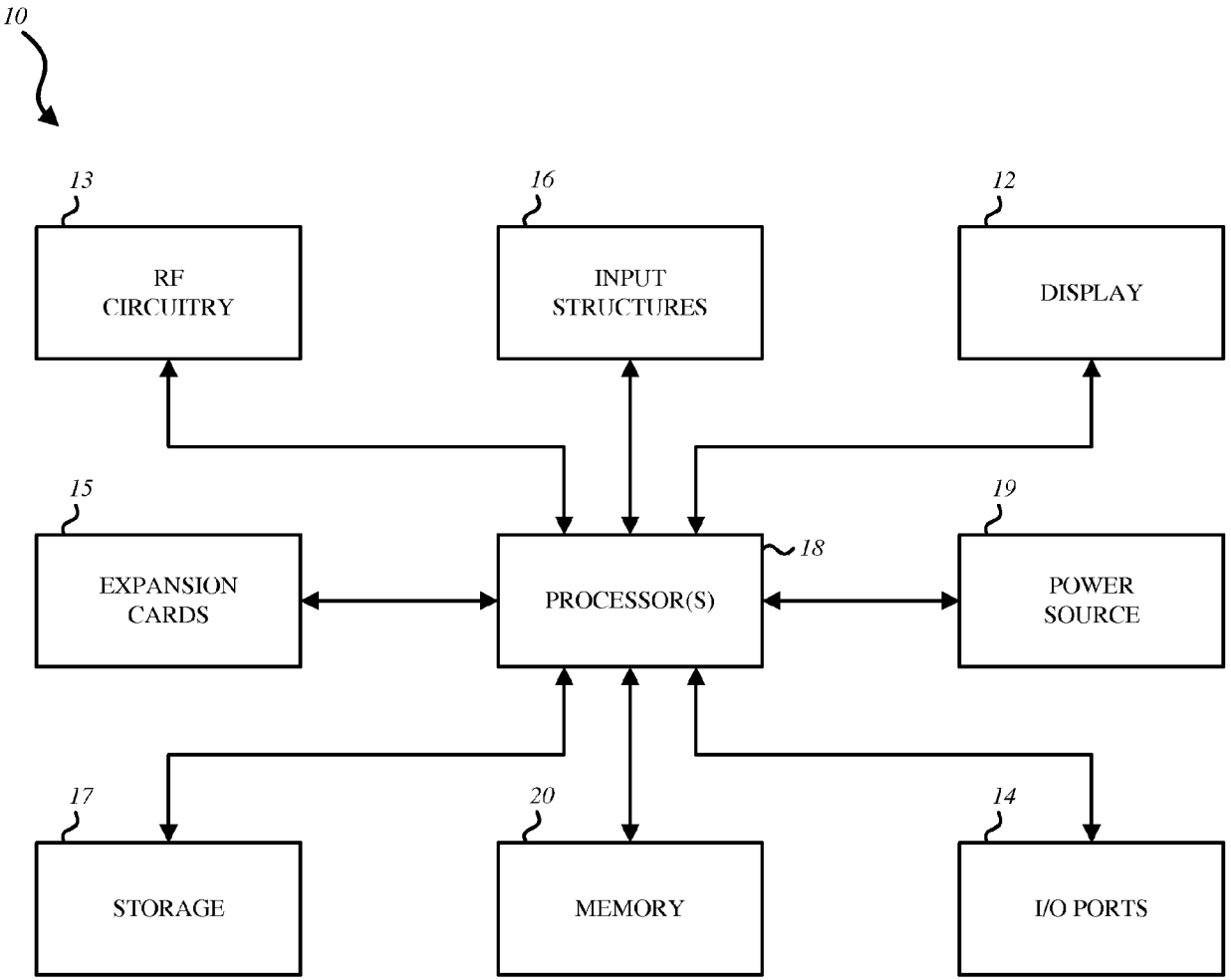
FIG. 5 is a block diagram of exemplary components of an electronic device in which the system for thermal monitoring of electro-mechanical actuators may be implemented in accordance with aspects of the present disclosure.

In one embodiment, system 1 is coupled to processing circuitry and storage that is included in electronic device 10 as discussed in FIG. 5. The processing circuitry included in device 10 may include a processor 18, such as a microprocessor, a microcontroller, a digital signal processor, or a central processing unit, and other needed integrated circuits such as glue logic. The term "processor" may refer to a device having two or more processing units or elements, e.g. a CPU with multiple processing cores. The processing circuitry may be used to control the operations of device 10 by executing software instructions or code stored in the storage 17. The storage 17 may include one or more different types of storage such as hard disk drive storage, nonvolatile memory 20, and volatile memory 20 such as dynamic random access memory. In some cases, a particular function as described below may be implemented as two or more pieces of software in the storage 17 that are being executed by different hardware units of a processor. The processing circuitry may execute instructions stored in memory that causes the processing circuitry to perform the method of thermal monitoring of an electro-mechanical actuator according to the embodiments as described herein. The processing circuitry may also execute instructions stored in memory that causes the processing circuitry to control the functions of each of the components of system 1 to cause the components (e.g., the temperature controller 2, pilot tone generator 3, temperature estimator 7, etc.) to perform the functions according to the embodiments as described herein.

Figure 2:
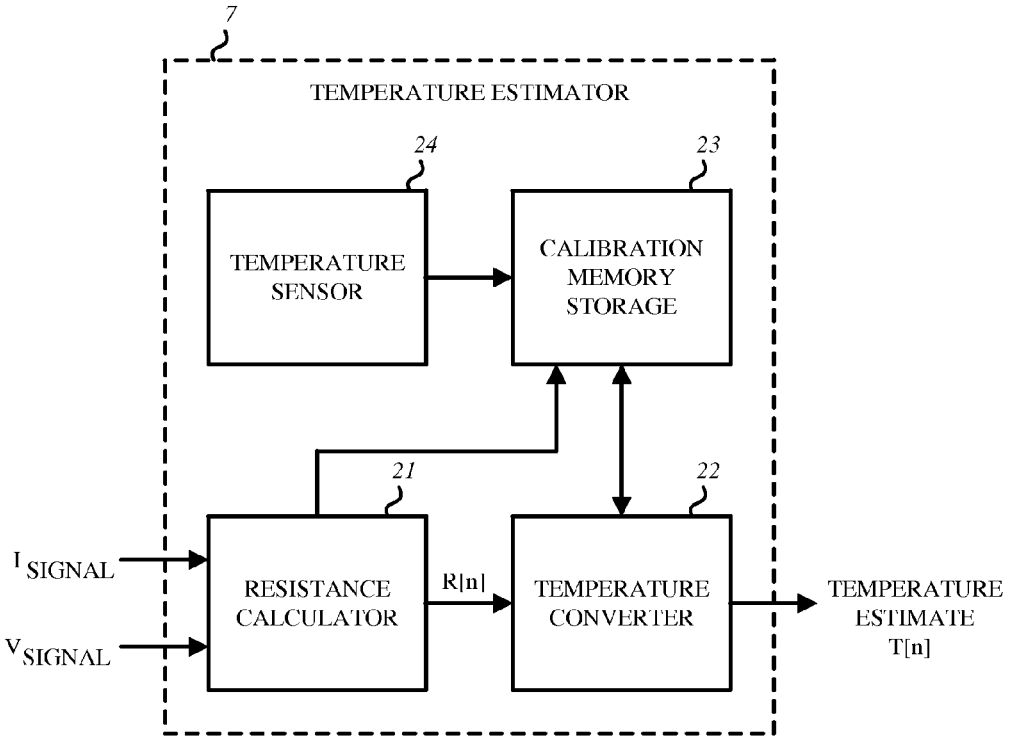
FIG. 2 illustrates a block diagram of the details of the temperature estimator that is included in the system in FIG. 1 according to one embodiment of the invention.

FIG. 2 illustrates a block diagram of the details of the temperature estimator 7 that is included in the system 1 in FIG. 1 according to one embodiment of the invention. The temperature estimator 7 comprises the resistance calculator 21, the temperature converter 22, the calibration memory storage 23, and the temperature sensor 24.

The resistance calculator 21 then receives the voltage signal ($V_{SIGNAL}[n]$) and the current signal ($I_{SIGNAL}[n]$). The resistance calculator 21 then computes the voice coil resistance estimate. The resistance calculator 21 may compute the voice coil resistance estimate (R[n]) using:

$$R[n]=V_{SIGNAL}[n]/I_{SIGNAL}[n].$$

The temperature converter 22 then receives the voice coil resistance estimate (R[n]) and computes the temperature estimate of the voice coil (T[n]) based on the voice coil resistance estimate, the calibration temperature, and the voice coil wire thermal coefficient of resistivity $\alpha$. The calibration temperature may be a voice coil reference temperature $T_{_REF}$ which is a temperature at which the electronic device was calibrated at during production. The calibration temperature may be unique for each device. In certain situations, changes to the electronic device 10 render it desirable for the electronic device 10 to perform self-calibration in the field (e.g., outside of the production setting). For instance, the electronic device 10 may performs self-calibration when the electro-mechanical actuator is installed in the device. If, for example, the electro-mechanical actuator needed to be replaced in the device 10, the new electro-mechanical actuator in the device 10 may cause a change in the electro-mechanical actuator resistance reference (e.g., $R_{_REF}$) at calibration reference temperature $T_{_REF}$. Accordingly, in one embodiment, the resistance calculator 21 may receive the voltage signal ($V_{SIGNAL}[n]$) and the current signal ($I_{SIGNAL}[n]$) for the self-calibration and compute the in-field calibration resistance (e.g., $R_{_REF}$). As shown in FIG. 2, the resistance calculator 21 may store the in-field calibration resistance (e.g., $R_{_REF}$) in the calibration memory storage 23. The in-field calibration resistance is thus an updated calibration reference for the electro-mechanical actuator (e.g., $R_{_REF}$). While the electro-mechanical actuator is being replaced, the calibration reference temperature $T_{_REF}$ may also be different from the calibration reference temperature in production. In another embodiment, the electronic device 10 may perform self-calibration at bootup of the device or after a software update of the device. In these scenarios, the electronic device 10 may receive updated parameters (e.g., a and b) that are stored in the calibration memory storage 23. These parameters discussed further below are included in an equation that relates the thermal coefficient of resistivity to the calibration reference temperature. In these scenarios, the electronic device 10 may determine an updated calibration temperature $T_{_REF}$ (e.g., the in-field calibration temperature). In one embodiment, the temperature sensor 24 measures the in-field calibration temperature and transmits the in-field calibration temperature to the calibration memory storage 23. In this embodiment, the processor 18 included in the electronic device 10 may generate a self-calibration signal that signals to the temperature sensor 24 to measure the updated calibration temperature $T_{_REF}$ and store the updated calibration temperature $T_{_REF}$ in the calibration memory storage 23, and signals to the temperature converter 22 to obtain the updated calibration temperature $T_{_REF}$ from the calibration memory storage 23 and to update (e.g., compute) the calculated thermal coefficient of resistivity. In some embodiments, the self-calibration signal may also signal to the resistance calculator 21 to receive the voltage signal ($V_{SIGNAL}[n]$) and the current signal ($I_{SIGNAL}[n]$) for the self-calibration and compute the updated calibration resistance (e.g., in-field calibration resistance ($R_{_REF}$)). In this embodiment, the self-calibration signal also signals to the temperature converter 22 to obtain the updated calibration resistance from the calibration memory storage 23 in addition to the updated calibration temperature $T_{_REF}$ and to update (e.g., compute) the calculated thermal coefficient of resistivity.

In one embodiment, the voice coil resistance estimate (R[n]) is converted into the temperature estimate using a temperature coefficient equation of voice coil materials such as:

$$T[n]=1/\alpha*(R[n]/R_{_REF}[n]-1)+T_{_REF}[n]$$

where T[n] is the voice coil temperature estimate, R[n] is run time estimate of voice coil resistance, $R_{_REF}$ is voice coil resistance reference at voice coil reference temperature $T_{_REF}$, and $\alpha$ is voice coil wire thermal coefficient of resistivity. As shown in FIG. 2, the temperature estimator 7 is coupled to the calibration memory storage 23 and may read $R_{_REF}$ and $T_{_REF}$ from calibration memory storage 23.

Figure 3:
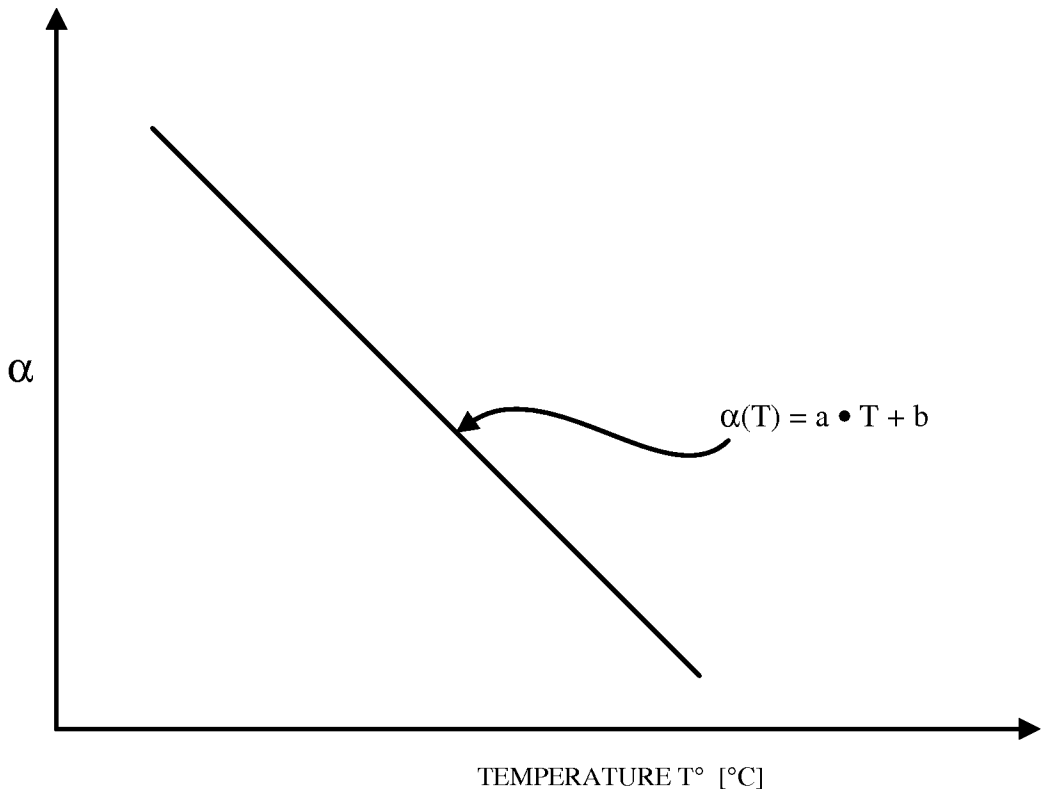
FIG. 3 illustrates an exemplary graph of the thermal coefficient of resistivity with respect to the calibration temperature according to one embodiment of the invention.

In one embodiment, the calibration memory storage 23 may also store therein parameters of an equation that relates a thermal coefficient of resistivity to the calibration temperature ($T_{_REF}$). In FIG. 3, an exemplary graph of the thermal coefficient of resistivity with respect to the calibration temperature according to one embodiment of the invention is illustrated. The thermal coefficient of resistivity is often established as a constant, however, in embodiments of the invention, the thermal coefficient of resistivity is more precisely defined as a function of temperature (e.g., the calibration temperature) as shown in FIG. 3. The thermal coefficient of resistivity may be expressed as a first order equation:

$$\alpha(T_{_REF})=a*T_{_REF}+b$$

a and b are numerical quantities that describe the first order relationship of $\alpha$ to temperature.

As shown in FIG. 3, a large discrepancy between the in-field calibration temperatures may result in very different calculated thermal coefficient of resistivity (e.g., $\alpha(T_{_REF})$). Thus, by using a more precise calculated thermal coefficient of resistivity (e.g., $\alpha(T_{_REF})$) in the temperature coefficient equation of voice coil materials, a more precise estimation of the temperature of the voice coil (e.g., T[n]) may be obtained.

In the production environment, the thermal coefficients of resistivity in an expected production calibration temperature ranges for a plurality of mobile devices were observed to obtain the parameters (e.g., a and b) of the first order equation that is dependent on production calibration temperature (e.g., $T_{_REF}$). In the field, when the mobile device 10 performs self-calibration, it is beneficial to obtain the updated (or in-field) calibration temperature (e.g., $T_{_REF}$) from a temperature sensor included in the mobile device 10 and update the calculated thermal coefficient of resistivity (e.g., $\alpha(T_{_REF})$) using the in-field calibration temperature, the parameters (e.g., a and b) and the equation.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 4:
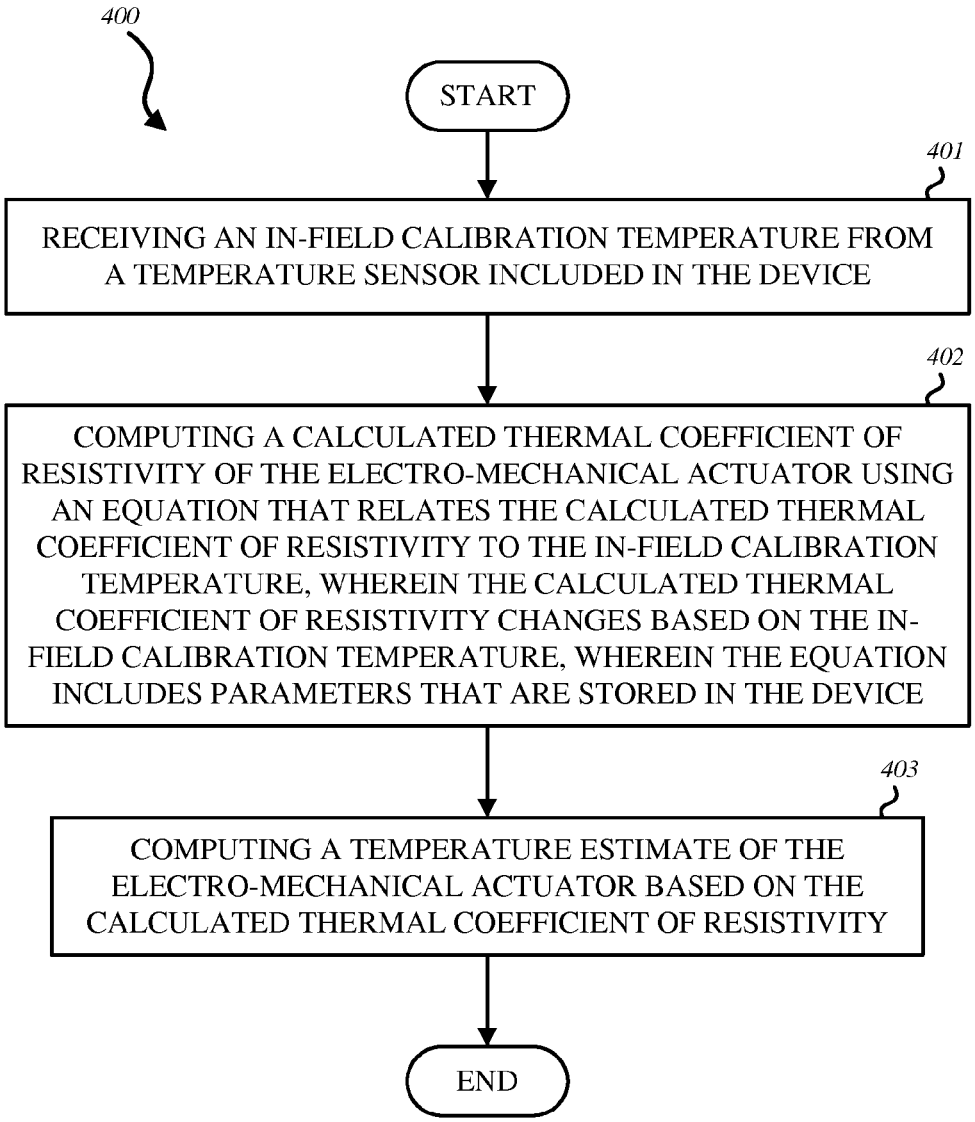
FIG. 4 illustrates a flow diagram of the method thermal monitoring of an electro-mechanical actuator included in an electronic device according to an embodiment of the invention.

FIG. 4 illustrates a flow diagram of the method 400 for thermal monitoring of an electro-mechanical actuator included in an electronic device according to an embodiment of the invention. The method 400 starts at Block 401 with the temperature converter 22 receiving an in-field calibration temperature $T_{_REF}$ from the temperature sensor 24 included in the device 10. The in-field calibration temperature $T_{_REF}$ may be stored in the calibration memory storage 23 and the temperature converter 22 may receive the in-field calibration temperature $T_{_REF}$ from the calibration memory storage 23. The temperature sensor 24 may be on-board in the electrical device 10. The temperature converter 22 may also receive an in-field calibration resistance ($R_{_REF}$) from a resistance calculator 21 included in the device 10. The in-field calibration resistance $R_{_REF}$ may also be stored in the calibration memory storage 23 and the temperature converter 22 may receive the in-field calibration resistance $R_{_REF}$ from the calibration memory storage 23.

At Block 402, the temperature converter 22 computes a calculated thermal coefficient of resistivity of the electro-mechanical actuator using an equation. The electro-mechanical actuators may be speakers. The equation relates the calculated thermal coefficient of resistivity of the electro-mechanical actuators (e.g., voice coils included in the speaker) to the in-field calibration temperature. The calculated thermal coefficient of resistivity changes based on the in-field calibration temperature. The equation may include parameters that are stored in calibration memory storage 23 of the device 10. In one embodiment, the temperature converter 22 receives the parameters from the calibration memory storage 23. In one embodiment, the equation is a first order equation including two parameters.

At Block 403, the temperature converter 22 computes a temperature estimate of the electro-mechanical actuator based on the calculated thermal coefficient of resistivity. In some embodiments, the temperature converter 22 uses the calculated thermal coefficient of resistivity and resistance estimate R[n] from the resistance calculator 21 to compute a temperature estimate of the voice coil. In some embodiments, the temperature converter 22 also uses the in-field calibration resistance $R_{_REF}$ to compute the temperature estimate of the voice coil.

In some embodiments, prior to Block 401, the processor included in device 10 generates a self-calibration signal that signals to the temperature estimator 7 to compute the calculated thermal coefficient of resistivity. The self-calibration signal may be generated (i) when the electro-mechanical actuator is installed in the device, (ii) at bootup of the device, or (iii) after a software update of the device.

FIG. 5 is a block diagram of exemplary components of an electronic device in which the system for thermal monitoring of electro-mechanical actuators may be implemented in accordance with aspects of the present disclosure. A general description of suitable electronic devices for performing these functions is provided below with respect to FIG. 5. Specifically, FIG. 5 is a block diagram depicting various components that may be present in electronic devices suitable for use with the present techniques. The electronic device 10 may be in the form of a computer, a handheld portable electronic device, and/or a computing device having a tablet-style form factor. These types of electronic devices, as well as other electronic devices providing comparable functionalities may be used in conjunction with the present techniques.

Keeping the above points in mind, FIG. 5 is a block diagram illustrating components that may be present in one such electronic device 10, and which may allow the device 10 to function in accordance with the techniques discussed herein. The various functional blocks shown in FIG. 5 may include hardware elements (including circuitry), software elements (including computer code stored on a computer-readable medium, such as a hard drive or system memory), or a combination of both hardware and software elements. It should be noted that FIG. 5 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 17, expansion card(s) 15, RF circuitry 13, and power source 19.

In the embodiment of the electronic device 10 in the form of a computer, the embodiment include computers that are generally portable (such as laptop, notebook, tablet, and handheld computers), as well as computers that are generally used in one place (such as conventional desktop computers, workstations, and servers).

The electronic device 10 may also take the form of other types of devices, such as mobile telephones, media players, personal data organizers, handheld game platforms, cameras, and/or combinations of such devices. For instance, the device 10 may be provided in the form of a handheld electronic device that includes various functionalities (such as the ability to take pictures, make telephone calls, access the Internet, communicate via email, record audio and/or video, listen to music, play games, connect to wireless networks, and so forth).

In another embodiment, the electronic device 10 may also be provided in the form of a portable multi-function tablet computing device. In certain embodiments, the tablet computing device may provide the functionality of media player, a web browser, a cellular phone, a gaming platform, a personal data organizer, and so forth.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components. In one embodiment, the machine-readable medium includes instructions stored thereon, which when executed by a processor, causes the processor to perform the methods as described above.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A method to perform thermal monitoring of an electro-mechanical actuator included in a device comprising:

receiving an in-field calibration temperature from a temperature sensor included in the device;

computing a calculated thermal coefficient of resistivity of the electro-mechanical actuator using an equation that relates the calculated thermal coefficient of resistivity to the in-field calibration temperature, wherein the calculated thermal coefficient of resistivity changes based on the in-field calibration temperature, wherein the equation includes parameters that are stored in the device;

computing a temperature estimate of the electro-mechanical actuator based on the calculated thermal coefficient of resistivity; and monitoring the temperature estimate of the electro-mechanical actuator to prevent overheating of the electro-mechanical actuator.

2. The method of claim 1, further comprising:

storing the in-field calibration temperature in the device.

3. The method of claim 1, further comprising:

generating a self-calibration signal that signals to compute the calculated thermal coefficient of resistivity.

4. The method of claim 3, wherein the self-calibration signal is generated (i) when the electro-mechanical actuator is installed in the device, (ii) at bootup of the device, or (iii) after a software update of the device.

5. The method of claim 1, wherein the parameters includes two parameters.

6. The method of claim 1, wherein the electro-mechanical actuator is a speaker that include a voice coil.

7. The method of claim 1, further comprising:

receiving and amplifying by an amplifier with current and voltage sensing an output signal that is transmitted to the electro-mechanical actuator, wherein the amplifier is coupled to the electro-mechanical actuator; and generating by the amplifier a current signal and a voltage signal based on signals from the electro-mechanical actuator.

8. The method of claim 7, further comprising:

receiving by a resistance calculator the current signal and the voltage signal in parallel from the amplifier, and calculating by a resistance calculator a resistance estimate of the electro-mechanical actuator based on the voltage signal and the current signal, wherein the resistance estimate changes while the electro-mechanical actuator is being driven by the output signal.

9. The method of claim 8, further comprising:

computing the temperature estimate of the electro-mechanical actuator based on the calculated thermal coefficient of resistivity and the resistance estimate.

10. An electronic device comprising:

an electro-mechanical actuator being driven by an output signal;

a temperature sensor to output an in-field calibration temperature; and a temperature estimator that includes a memory storing the in-field calibration temperature and parameters of an equation that relates a calculated thermal coefficient of resistivity of the electro-mechanical actuator to the in-field calibration temperature, wherein the calculated thermal coefficient of resistivity changes based on the in-field calibration temperature, a temperature converter to receive the parameters and the in-field calibration temperature from the memory, to compute the calculated thermal coefficient of resistivity of the electro-mechanical actuator using the parameters, the in-field calibration temperature and the equation, and to compute a temperature estimate of the electro-mechanical actuator based on the calculated thermal coefficient of resistivity, and a temperature controller to monitor the temperature estimate of the electro-mechanical actuator to prevent overheating of the electro-mechanical actuator.

11. The electronic device of claim 10, further comprising:

a pilot tone generator to generate a pilot tone;

a combiner to inject the pilot tone into a driving signal, and to generate the output signal, wherein the electro-mechanical actuator outputs the output signal.

12. The electronic device of claim 11, further comprising:

an amplifier with current and voltage sensing coupled to the electro-mechanical actuator to receive and amplify the output signal that is transmitted to the electro-mechanical actuator; and to generate a current signal and a voltage signal based on signals from the electro-mechanical actuator.

13. The electronic device of claim 12, wherein the temperature estimator further comprises:

a resistance calculator to receive the current signal and the voltage signal in parallel from the amplifier, and to calculate a resistance estimate of the electro-mechanical actuator based on the voltage signal and the current signal, wherein the resistance estimate of the electro-mechanical actuator changes while the electro-mechanical actuator is being driven by the output signal.

14. The electronic device of claim 13, wherein the temperature converter computes the temperature estimate of the electro-mechanical actuator based on the calculated thermal coefficient of resistivity and the resistance estimate.

15. The electronic device of claim 14, wherein the temperature controller to adjust a level of the input signal based on the temperature estimate.

16. The electronic device of claim 15, wherein the electro-mechanical actuator is a speaker that includes a voice coil, the driving signal is an audio input signal, and the output signal is an audio output signal.

17. The electronic device of claim 16, wherein the speaker is a microspeaker.

18. A computer-readable storage medium having instructions stored thereon, when executed by a processor, causes the processor to perform a method of thermal monitoring of an electro-mechanical actuator included in a device, the method comprising:

receiving an in-field calibration temperature from a temperature sensor included in the device;

computing a calculated thermal coefficient of resistivity of the electro-mechanical actuator using an equation that relates the calculated thermal coefficient of resistivity of the electro-mechanical actuator to the in-field calibration temperature, wherein the calculated thermal coefficient of resistivity changes based on the in-field calibration temperature, wherein the equation includes parameters that that are stored in the device;

computing a temperature estimate based on the calculated thermal coefficient of resistivity; and monitoring the temperature estimate of the electro-mechanical actuator to prevent overheating of the electro-mechanical actuator.

19. The computer-readable storage medium of claim 18 having instructions stored thereon, when executed by the processor, causes the processor to perform the method further comprising:

storing the in-field calibration temperature in the device.

20. The computer-readable storage medium of claim 19 having instructions stored thereon, when executed by the processor, causes the processor to perform the method further comprising:

generating a self-calibration signal that signals to compute the calculated thermal coefficient of resistivity.

21. The computer-readable storage medium of claim 20, wherein the self-calibration signal is generated (i) when the electro-mechanical actuator is installed in the device, (ii) at bootup of the device, or (iii) after a software update of the device.

22. The computer-readable storage medium of claim 19, wherein the electro-mechanical actuator is a speaker that include a voice coil.

23. The computer-readable storage medium of claim 19 having instructions stored thereon, when executed by the processor, causes the processor to perform the method further comprising:

receiving and amplifying an output signal that is transmitted to the electro-mechanical actuator, wherein the amplifier is coupled to the electro-mechanical actuator; and generating a current signal and a voltage signal based on signals from the electro-mechanical actuator.

24. The computer-readable storage medium of claim 23, having instructions stored thereon, when executed by the processor, causes the processor to perform the method further comprising:

receiving the current signal and the voltage signal in parallel from the amplifier, and calculating a resistance estimate of the electro-mechanical actuator based on the voltage signal and the current signal, wherein the resistance estimate changes while the electro-mechanical actuator is being driven by the output signal.

25. The computer-readable storage medium of claim 24, having instructions stored thereon, when executed by the processor, causes the processor to perform the method further comprising:

computing the temperature estimate based on the calculated thermal coefficient of resistivity and the resistance estimate.

* * * * *